US012024989B2

(12) United States Patent
Bullen et al.

(10) Patent No.: US 12,024,989 B2
(45) Date of Patent: Jul. 2, 2024

(54) AIR LIFTING SAND

(71) Applicant: SIO SILICA CORPORATION, Calgary (CA)

(72) Inventors: Brent Randal Bullen, Heritage Pointe (CA); Laura Amanda Weeden, Calgary (CA)

(73) Assignee: SIO SILICA COPORATION, Calgary (CA)

( * ) Notice: Subject to any disclaimer, the term of this patent is extended or adjusted under 35 U.S.C. 154(b) by 0 days.

(21) Appl. No.: 17/922,509

(22) PCT Filed: May 1, 2020

(86) PCT No.: PCT/IB2020/054159

§ 371 (c)(1),
(2) Date: Oct. 31, 2022

(87) PCT Pub. No.: WO2021/220040

PCT Pub. Date: Nov. 4, 2021

(65) Prior Publication Data

US 2023/0193735 A1 Jun. 22, 2023

(51) Int. Cl.

| | |
|---|---|
| ***E21B 43/29*** | (2006.01) |
| ***E21B 43/25*** | (2006.01) |
| ***E21B 43/38*** | (2006.01) |

(52) U.S. Cl.

CPC ..... *E21B 43/29* (2013.01); *E21B 43/255* (2013.01); *E21B 43/385* (2013.01)

(58) Field of Classification Search

CPC ..... E21B 43/29; E21B 43/255; E21B 43/385; E21B 43/35

See application file for complete search history.

(56) References Cited

U.S. PATENT DOCUMENTS

| | | | | |
|---|---|---|---|---|
| 9,534,482 | B2 * | 1/2017 | Schneider | E21B 43/24 |
| 2012/0175127 | A1 * | 7/2012 | Yale | E21B 43/124 166/372 |
| 2015/0107905 | A1 * | 4/2015 | Kinley | E21B 7/18 175/57 |

* cited by examiner

*Primary Examiner* — Catherine Loikith
(74) *Attorney, Agent, or Firm* — DLA PIPER LLP (US)

(57) ABSTRACT

An apparatus and method for extracting sand from an underground sandstone formation. The apparatus comprising: a conduit having an upper end and a lower end to engage a sandstone formation, a gas injection line to inject gas at an injection point, wherein the gas injected at the injection point generates a low pressure region at the lower end to draw a sand slurry from the sandstone formation, and a collection port proximate to the upper end of the conduit wherein the sand slurry in the conduit is to be removed. The method comprising: lowering a pipe and air injection line into a sandstone formation, injecting air into the pipe to create a low pressure region at a lower end of the pipe to draw a sand slurry from the formation, and collecting the sand slurry at a collection port.

20 Claims, 8 Drawing Sheets

AIR LIFTING SAND

PRIORITY

This application is a 371 of International Application No. PCT/IB2020/054159, filed Mar. 1, 2020, the entirety of which is incorporated herein by reference.

BACKGROUND

Unconsolidated sand may be found underground in certain formations. Such sand formations may have particular qualities, such as a high level of purity with silica content about 99% or more, which may be used in a wide variety of applications. The formations are generally found under layers of other types of rock. Accordingly, the removal of the sand may be carried out by mining for the sand and excavating the sand. For example, an open-pit mining technique may be used to remove the upper layer of rock so that the sand underneath may be recovered. The sand recovered may be used in a wide variety of applications. For example, the sand may be used as frac sand in the oil and gas industry for hydraulic fracturing to release oil and gas in a reservoir. Other uses for sand may include use for sand blasting, scouring cleansers, grinding media, grit for sanding and sawing, glass making, fiber optics manufacturing, foundry sand, silica metals, photovoltaic cells, and other applications.

BRIEF DESCRIPTION OF THE DRAWINGS

Reference will now be made, by way of example only, to the accompanying drawings in which.

DETAILED DESCRIPTION

As used herein, any usage of terms that suggest an absolute orientation (e.g. "top", "bottom", "up", "down", "left", "right", etc.) may be for illustrative convenience and refer to the orientation shown in a particular figure. However, such terms are not to be construed in a limiting sense as it is contemplated that various components will, in practice, be utilized in orientations that are the same as, or different than those described or shown.

Sand from sources such as glacial deposits as well as most beach and riverbank sand is low purity and may include impurities and sharp angles that may make it not suitable for some uses, such as hydraulic fracturing. Therefore, to obtain sand or other unconsolidated materials having target properties for specific applications may involve searching for such materials in limited locations. For example, high purity sand with a high proportion of silica may be typically mined from sandstone formations located near the surface at some locations where such deposits exist. These sandstone formations may be accessed by removing top layers such as topsoil and rock layers to expose a sandstone formation. These examples of sandstone formations may be typically a hard formation which may be blasted apart with explosives and collected and crushed to a suitable size for use.

In some rock formations, sand having a specific property may be found in sandstone formations that are unconsolidated and deep underground in water reservoirs or aquifers. The reservoirs may be about 200 feet below the surface, about 325 feet, about 650 feet, or even deeper, which poses challenges to removing the sand. The sand may be excavated by removing the material above the reservoir; however, such an excavation is a significant undertaking requiring several different types of machinery to remove the material. In addition, exposing an aquifer by removing layers above is environmentally dangerous and involve significant costs to contain the water that will be released once the aquifer is exposed. Furthermore, the material removed from above the reservoir is to be transported away from the site. Overall, a large amount of equipment and energy is used to move the material above the reservoir away so that the sand may be brought to the surface. Therefore, using conventional sand mining techniques may become prohibitively expensive when the sand is located at such a distance from the surface.

An apparatus to remove sand from an unconsolidated underground sandstone formation in a water reservoir is provided. The apparatus includes a conduit and a gas injection line to generate an area of low pressure near the interface with the sandstone formation to draw in unconsolidated sand to bring to the surface. The sand is brought to the surface in the form of a slurry with grains of sand and water.

Figure 1:
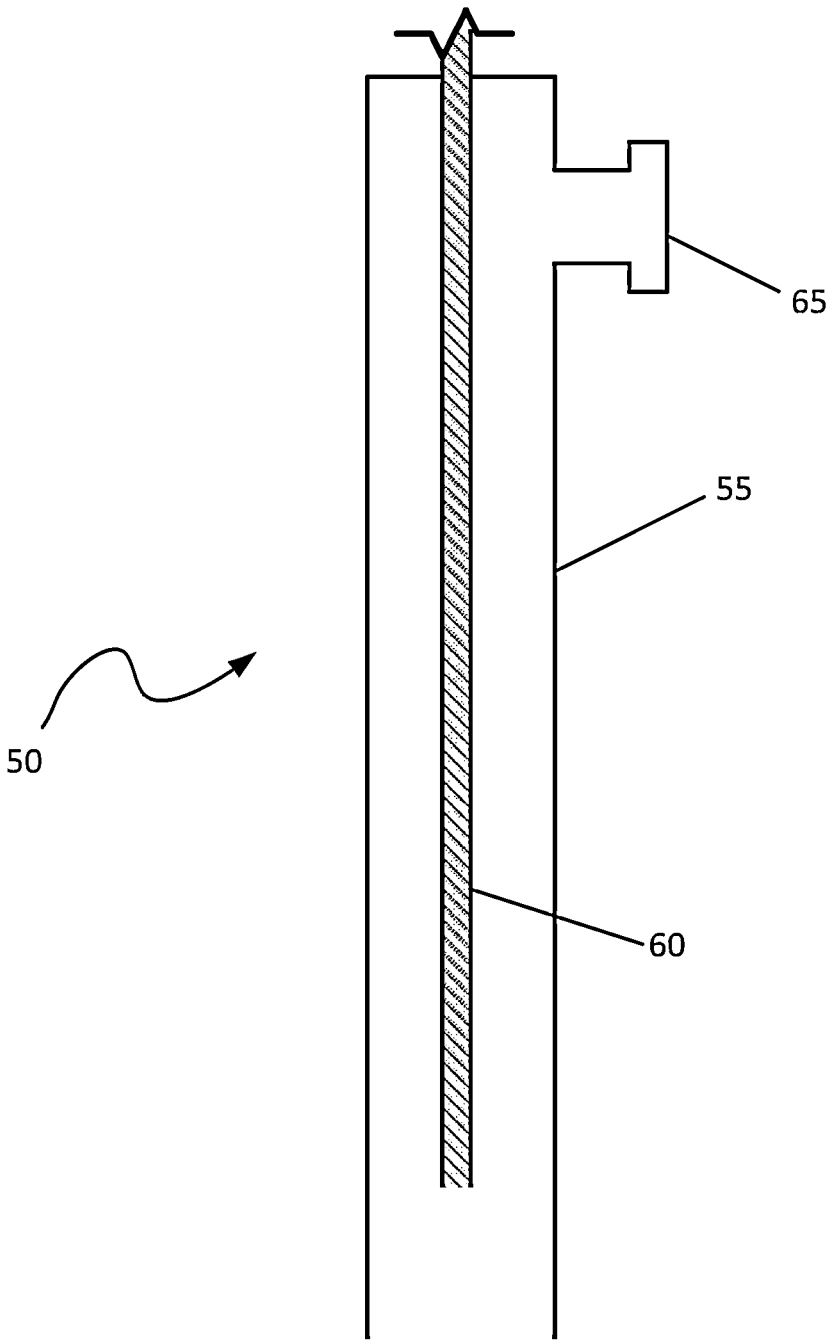
FIG. 1 is an example apparatus to extract sand from an underground sandstone formation in an underground water reservoir.

Referring to FIG. 1, an apparatus 50 to extract sand from an underground sandstone formation in an underground water reservoir, such as an aquifer, is provided. The apparatus 50 is to be inserted into a well from the surface to the underground sandstone formation. It is to be appreciated by a person of skill with the benefit of this description that the depth to which the apparatus 50 is to be inserted is not particularly limited. Accordingly, the apparatus 50 may be applied to various sandstone formations at different depths. In the present example, the apparatus 50 includes a conduit 55, a gas injection line 60, and a collection port 65.

The conduit 55 is to engage a sandstone formation at a lower end of the well. The conduit 55 is not particularly limited and may be constructed from one of several different structures, shapes, and materials. In the present example, the conduit 55 is a steel conduit with a circular cross section having diameter of about eight inches. In other examples, alternative materials such as cast iron, copper, wrought iron, or galvanized metals, or plastics like polyvinyl chloride, acrylonitrile-butadiene-styrene, and/or polyethylene may be used In other examples, the conduit 55 may also have a different cross section or a varying cross sectional area along the length of the conduit from the sandstone formation to surface. Furthermore, the conduit 55 may include curves or changes in directions in applications where the well is not a vertical straight well. For example, the well may include horizontal portions or the conduit 55 may extend at an angle in the underground reservoir as a void is formed from the removal of sand to remove sand from the sides of the void.

The length of the conduit 55 is not particularly limited. In the present example, the conduit 55 may extend about 200 feet from the surface to the top of the sandstone formation. In other examples, the lower end of the conduit 55 may be positioned deeper to about 500 feet, about 715 feet, or even deeper to about 2000 feet in some applications. The conduit 55 may also be extendible in some examples during the extraction. For example, the conduit 55 may be moved while sand is extracted and flowing therethrough. The manner by which the conduit 55 is moved is not particularly limited and the range of movement may be limited by the position of the collection port 65. In particular, it is to be appreciated that if the collection port 65 is to remain above the surface as in the present example, a lower limit of movement is set by this restriction. The upper limit of movement may be restricted by the ability to provide support to the portion of the conduit 55 above the surface either by the strength of the conduit itself or with additional support structures on the surface to avoid collapse. In the present example, the range of motion of the conduit 55 is about 20 feet. In other examples, the range of motion may be up to about 50 feet or more. Once the limits of movement are reached, as the overall length of the conduit 55 may be extended or retracted by adding or removing sections, respectively.

The gas injection line 60 is to inject gas from the surface to an injection point proximate to the lower end of the conduit 55. The gas injected via the gas injection line 60 is not limited. In the present example, a compressor (not shown) at the surface may be used to inject air with a positive pressure and high volume flow rate, such as at a pressure within the range of about 30 psi to 90 psi with a flow rate of about 300 cubic feet per minute to about 600 cubic feet per minute. In other examples, a gas source, such as from a gas cylinder or a storage tank may provide the gas injection via a pressure regulator. In such examples, the gas injected at the injection point may include other types of gas, such as an inert gas.

It is to be appreciated by a person of skill in the art with the benefit of this description that by injecting gas that is eventually to flow upward in the conduit 55, a low pressure region will be formed at the lower end of the conduit 55 to draw a sand slurry from the sandstone formation into the conduit 55. The gas injection line 60 may inject gas at varying pressures and flow rates to maintain the low pressure region as a sand slurry is continuously extracted. Furthermore, in some examples, the gas injection line 60 may be used to further inject gas beyond the conduit 55 to generate a pressure vibration or pulsed air to agitate the sand in the sandstone formation from time to time.

The collection port 65 is disposed near the upper end of the conduit 55 generally above the surface. The sand slurry extracted via the conduit 55 is to be removed from the apparatus via the collection port 65. In the present example, the sand slurry may be forced out of a hole and discharged into a container or vehicle collecting the sand slurry and air. In some examples, the collection port 65 may be connected to downstream processing equipment via additional piping (not shown). In other examples, the sand slurry may be collected in a hopper or other container (not shown) and subsequently removed via the collection port 65.

The collection port 65 is not particularly limited. In the present example, the collection port 65 is perpendicular to the conduit 55 and ejects the sand slurry in a horizontal direction to be subsequently collected. In other examples, the collection port 65 may be oriented to eject the sand slurry in a different direction. In further examples, the collection port 65 may also be at the end of the conduit 55, such that the sand slurry is ejected in an upward direction or directed by an elbow in the conduit 55.

Figure 2:
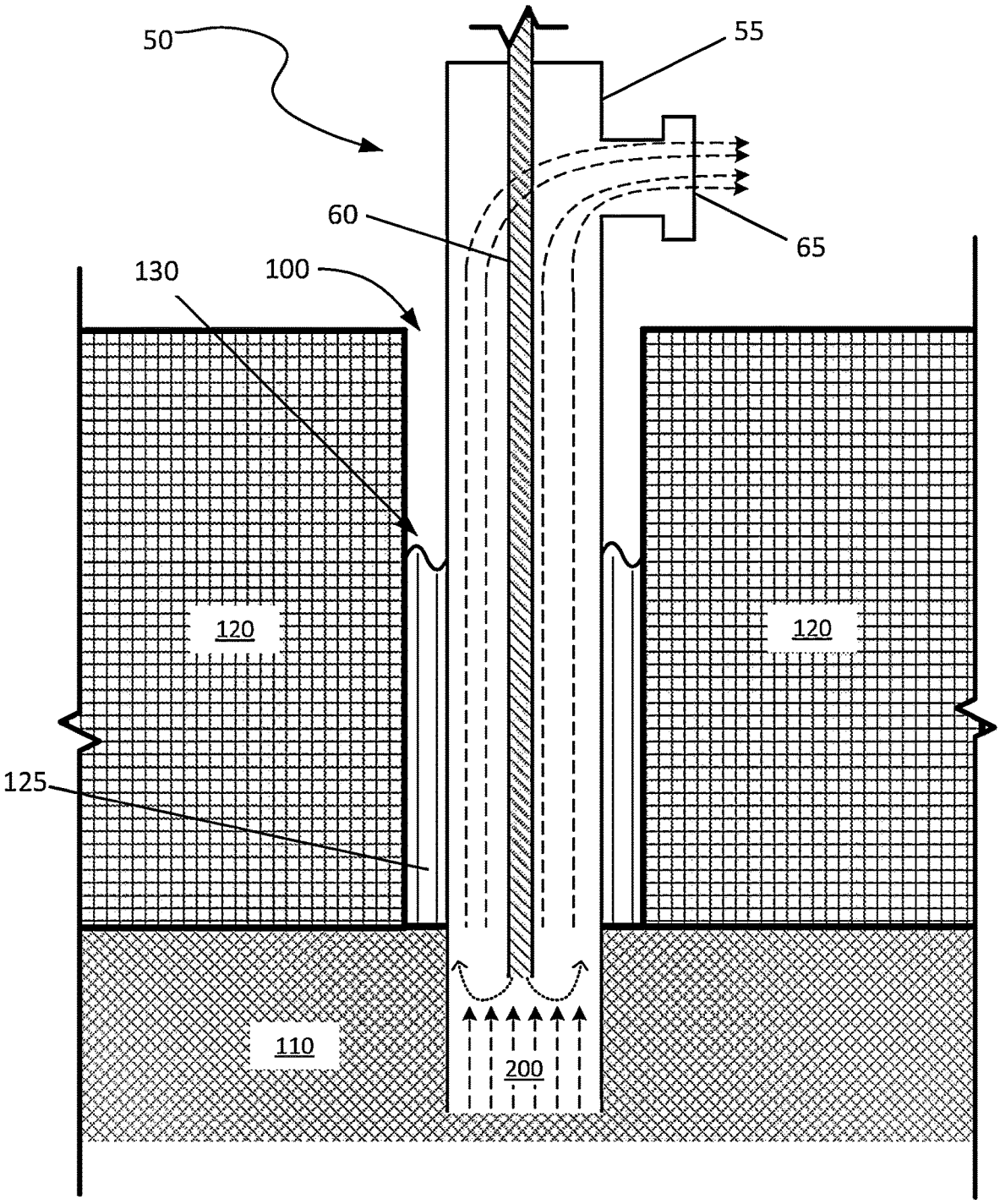
FIG. 2 is a diagram showing the apparatus of FIG. 1 installed in a well during operation.

Referring to FIG. 2, the apparatus 50 is shown in operation at a well 100 above a sandstone formation 110. The composition of the sandstone formation 110 is not particularly limited and generally includes unconsolidated sand in an underground aquifer. In the present example, the sandstone formation 110 includes high purity sand having over about 99 percent silica and about 0.4 percent clay content. However, in other examples, the sand may include other minerals and be of a lower quality. Furthermore, the sandstone formation 110 is in an aquifer covered by another layer 120, which may include shale, limestone, till or any combination of these and/or other types of materials. Since the aquifer in which the sandstone formation 110 is found may be under pressure, the water level 130 rises above the formation upon the drilling of the well 100 to fill the well 100 with an amount of water to provide a hydrostatic head 125 and the water level 130. The height of the water level 130 is not particularly limited and in some examples where the water level 130 is too low, such as below the top of the sandstone formation 110, water may be added to the well from an external source to establish the water level 130 at a sufficient height to increase the water pressure within the sandstone formation 110 to facilitate the extraction of the sandstone slurry.

Figure 3:
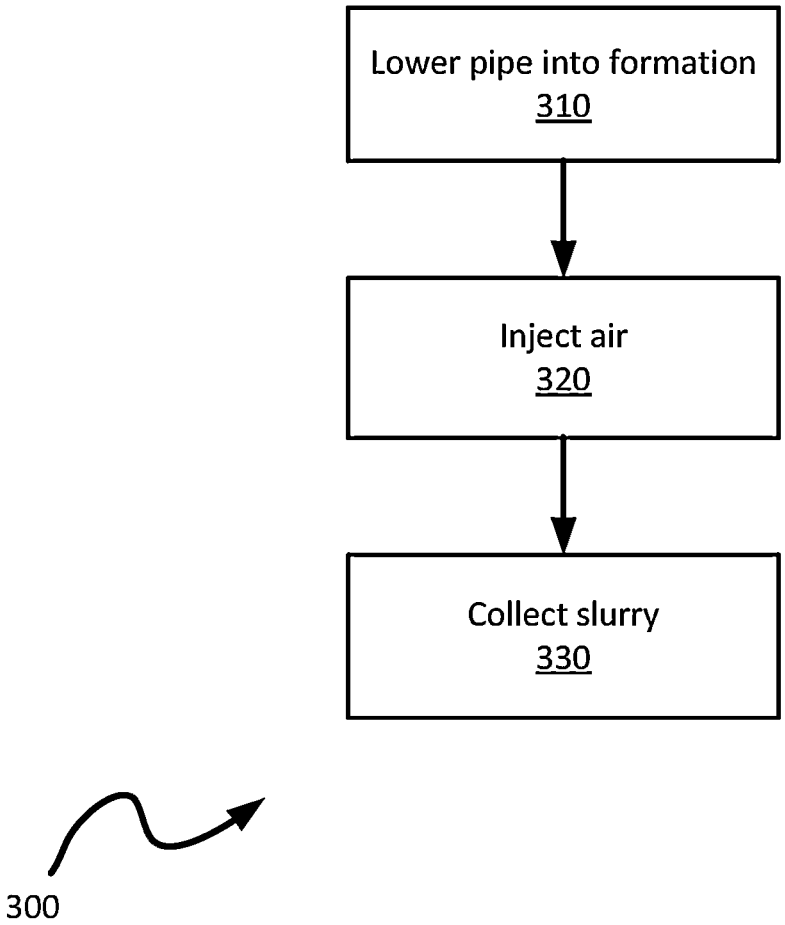
FIG. 3 is a flowchart of an example of a method of extracting sand from an underground sandstone formation in an underground water reservoir.

Referring to FIG. 3, a flowchart of extracting sand from a sandstone formation 110 via a well 100 is generally shown at 300. In order to assist in the explanation of method 300, it will be assumed that method 300 may be performed with the apparatus 50. Indeed, the method 300 may be one way in which apparatus 50 may be configured. Furthermore, the following discussion of method 300 may lead to a further understanding of the apparatus 50 and its various components. It is to be emphasized, that method 300 may not be performed in the exact sequence as shown, and various blocks may be performed in parallel rather than in sequence, such as blocks 320 and 330 discussed in more detail below.

Block 310 involves lowering the conduit 55, which may be a steel pipe into a sandstone formation 110. In the present example, the conduit 55 is lowered into the well 100 drilled through a shale layer 120 into the sandstone formation 110, which may be aquifer with sand. It is to be appreciated that the well 100 is not particularly limited and may vary in depth. Furthermore, the well 100 may be a newly drilled well for the purpose of sand extraction or in other cases, the well 100 may be an old well that is repurposed for sand extraction. The manner by which the conduit 55 is lowered is not particularly limited. For example, the conduit 55 may include a plurality of sections of steel pipe where additional sections may be inserted above or near the surface to extend the conduit 55 into the sandstone formation 110. The depth into which the conduit 55 is inserted into the sandstone formation 110 is not particularly limited. In the present example, the conduit may be inserted about 20 feet into the sandstone formation 110.

Similar to the conduit 55, the gas injection line 60 is lowered into the well 100. The manner by which the conduit 55 is lowered is not particularly limited. In the present example, the relative position of the gas injection line 60 to the conduit 55 may be independently controlled. For example, the gas injection line 60 may be raised and lowered relative to the lower end of the conduit 55 to control or vary a low pressure region generated near the lower end of the conduit 55. It is to be appreciated by a person of skill in the art with the benefit of this description that the position of the gas injection line 60 is not limited and may be below the lower end of the conduit 55. In such an example, the sand near the lower end of the conduit 55 may be able to form a sufficient seal around the conduit 55 to allow gas from the gas injection line 60 to continue lifting material up through the conduit 55. By varying the low pressure region 200, the flow of sand slurry extracted from the sandstone formation 110 may be adjusted to achieve a stable rate to facilitate collection procedures. Furthermore, the gas injection line 60 may include a plurality of sections of tubing where additional sections may be inserted above or near the surface to extend the gas injection line 60 as the conduit 55 extending down the well 100 and into the sandstone formation 110.

Next, block 330 involves injecting air from the surface into the conduit 55 proximate to the lower end. The manner by which the air is injected is not limited. In the present example, the gas injection line 60 enters the conduit 55 at the upper end and extends along the length of the conduit to the lower end. The gas injection line 60 may be connected to a pump delivering air at a rate of about 300 cubic feet per minute at in the range of about 30 psi to about 90 psi. The air is delivered to a region proximate to the lower end of the conduit 55. Although the present example illustrates the gas injection line 60 to be at approximately the center of the conduit 55, variations are possible. For example, the gas injection line 60 may be a separate tube or pipe external to the conduit 55. Accordingly, the gas injection line 60 may inject gas into the conduit 55 close to the lower end.

As the air enters the lower end of the conduit 55 via the gas injection line 60, the air rises back to the water level 130 where it rejoins with atmosphere. The movement of the air toward the surface caused by the injection of the air via the gas injection line 60 generates a low pressure region 200. The low pressure region 200 is not particularly limited. For example, the pressure differential between the low pressure region 200 and the aquifer may be about 20 psi to about 40 psi. The pressure differential draws a sand slurry into the conduit 55 from the sandstone formation 110. The sand slurry is then lifted up the length of the conduit 55 with the air injected from the gas injection line 60. It is to be appreciated by a person of skill with the benefit of this description that as material is lifted to the surface, the pressure at the low pressure region 200 is further decreased. Accordingly, the pressure differential between the low pressure region 200 and the pressure in the aquifer is increased, which in turn improves the drawing of sand into the conduit 55.

The injection of air into the conduit 55 may be adjusted during the extraction process to maintain the flow of the sand slurry through the conduit 55 to the collection port 65. For example, the initial air pressure at which air is injected via the gas injection line 60 may be kept below the pressure of the sandstone formation 110. Once a flow of the sand slurry from the sandstone formation 110 is established, the injection point of the air may be adjusted by moving the gas injection line 60 relative to the conduit 55 in some examples. It is to be appreciated that by adjusting the injection point relative to the conduit 55, the flow of the sand slurry to the surface may be maintained as the sand and water interface moves during operation. In further examples, the pressure of the air injected via the gas injection line 60 as well as the volume of air injected may be adjusted to increase the pumping and lifting efficiency of the sand slurry through the conduit 55.

The movement of the sand slurry may be created by the pressure differential at the entrance to lower end of the conduit 55 as a low pressure region 200 is created and the higher pressure in the sandstone formation 110 around the bottom of the conduit 55 pushes water and sand into the conduit 55. Above the introduction point of air in the conduit 55 via the gas injection line 60, the pressure is higher but neutral to the formation due to hydrostatic head 125 in the surrounding wellbore. Once the sand slurry in the conduit 55 moves up past the static water level 130, fluid flow generates a conservation of momentum effect as the sand slurry is discharged from the collection port 65.

In some examples, as sand is removed from the sandstone formation 110, the lower end of the conduit 55 may be lowered further into the sandstone formation 110 so the bottom suction of the lower end of the conduit 55 follows the sand/water interface in the sandstone formation 110 as material is removed to the surface. Accordingly, this may allow for continued extraction of sand as voids are formed during the extraction process.

Block 330 comprises collecting the sand slurry exiting the conduit 55 via the collection port 65 at an upper end above surface. The manner by which the sand slurry is collected is not particularly limited. For example, the sand slurry may be ejected from the collection port into a hopper or dump truck for transportation. In other examples, the sand slurry may be transferred to downstream equipment for additional processing, such as a sump tank.

Figure 4:
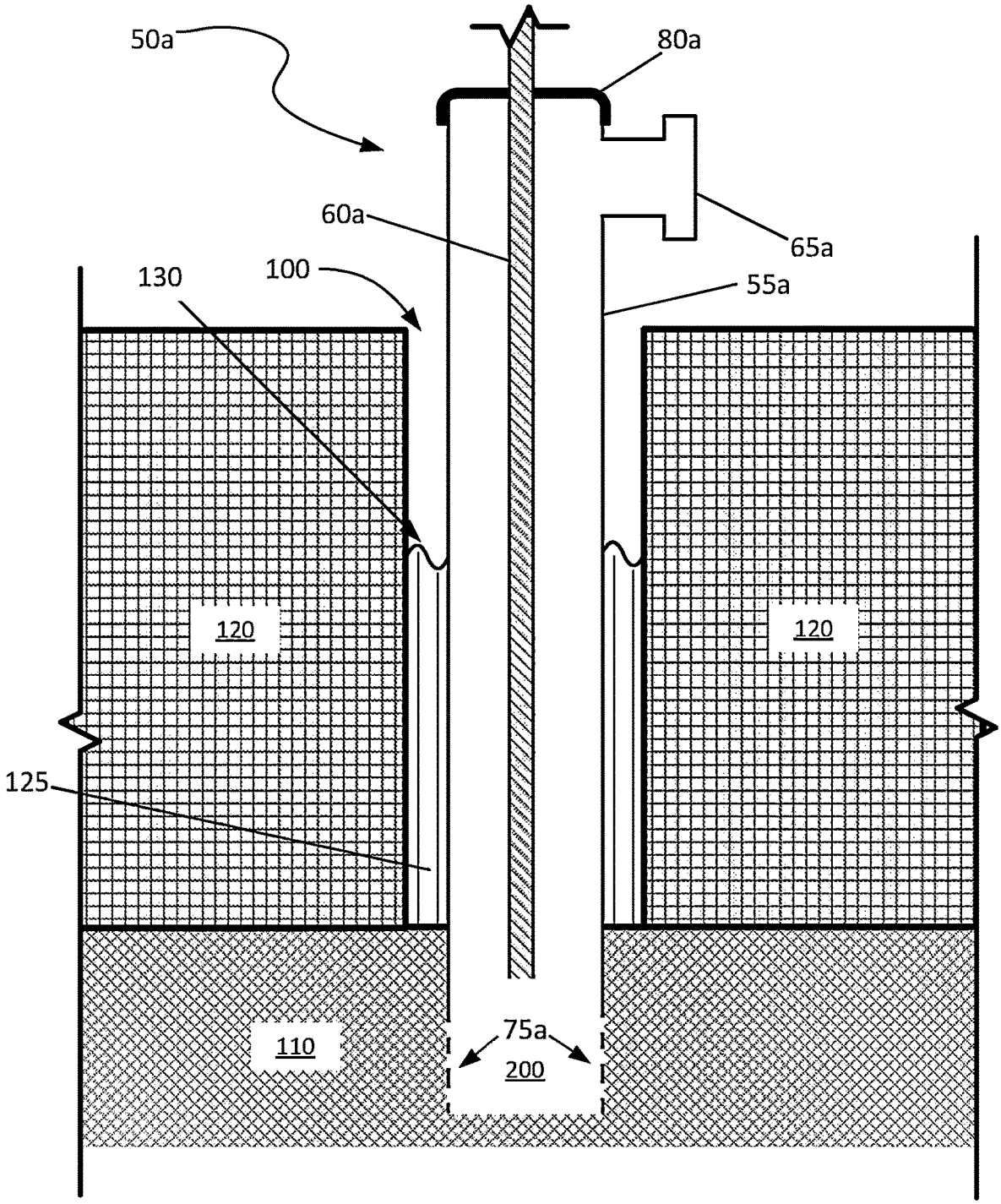
FIG. 4 is another example apparatus installed on a well to extract sand from an underground sandstone formation.

Referring to FIG. 4, another example of an apparatus 50*a* to extract sand from an underground sandstone formation 110 in a water reservoir, such as an aquifer, is provided. Like components of the apparatus 50*a* bear like reference to their counterparts in the apparatus 50, except followed by the suffix "a". In the present example, the apparatus 50*a* may be inserted into a well 100 from the surface to the underground sandstone formation 110. The apparatus 50*a* includes a conduit 55*a*, a gas injection line 60*a*, a collection port 65*a*, a perforated wall 75*a*, and a cover 80*a*.

In the present example, the conduit 55*a*, the gas injection line 60*a*, and the collection port 65*a* are substantially similar to the conduit 55, the gas injection line 60, and the collection port 65, respectively. In particular, the conduit 55*a* is to engage a sandstone formation 110 near a lower end of the well 100. The gas injection line 60*a* is to inject gas inside the conduit 55*a* proximate to the lower end of the conduit. The collection port 65*a* is used to remove the sand slurry to be removed from the conduit 55*a*.

In the present example, the apparatus 50*a* further includes a perforated wall 75*a* at the lower end of the conduit 55*a*. The perforated wall 75*a* is to increase the surface area between the low pressure region 200 and the sandstone formation 110. It is to be appreciated by a person of skill in the art with the benefit of this description, that by increasing the surface area during the initial phase of extracting sand from the sandstone formation, additional sand will be drawn into the conduit to the collection port 65*a* to provide the conservation of momentum effect. In examples where the perforated wall 75*a* is continuously lowered into the sand, the benefits of the increased surface area may continue for the duration of the extraction process as long as the perforated wall remains below the sand/water interface.

The cover 80*a* is disposed at an upper end of the conduit to provide a seal. It is to be appreciated by a person of skill with the benefit of this description that the cover 80*a* is not particularly limited and is to direct the flow of the sand slurry to the collection port 65*a*. Accordingly, the material from which the cover 80*a* is constructed is not limited. In the present example, the cover 80*a* is a made from steel with a flexible membrane seal to seal the upper end of the conduit 55*a*. In other examples, the cover 80*a* may be constructed of other metals, rubber, cork, or a plastic (e.g. polyvinyl chloride or similar material). The cover 80*a* is to be secured at the upper end of the conduit 55*a* with sufficient strength to withstand the pressure forces from the impact of the sand slurry moving at high velocity toward the upper end of the conduit. The manner by which the cover 80*a* is secured is not limited and may involve using a fastener such as a clamp or screw. In other examples, the cover 80*a* may be affixed with a sealant such as epoxy. In further examples, the cover 80*a* may also be friction fitted to an opening of the conduit 55*a*.

In the present example, the cover 80*a* includes an opening for the gas injection line 60*a* to pass through. In the present example where the cover 80*a* is formed from a rubber material, the opening may be slightly smaller than the outside diameter of the gas injection line 60*a* such that the cover 80*a* forms an airtight seal at the upper end of the conduit 55*a*.

In some examples, the cover 80*a* may slidably engage the gas injection line 60*a* such that the gas injection line 60*a* may able to move within the conduit 55*a* in a vertical manner. The movement of the gas injection line 60*a* allows for the gas injection point within the conduit 55*a* to be controlled to adjust the flow rate of the sand slurry drawn into the conduit 55*a*. Furthermore, the gas injection line 60*a* may also be lowered beyond the lower end of the conduit and into the sandstone formation 110 to generate a pressure vibration or inject a pulse of air to agitate the sand from time to time.

Figure 5:
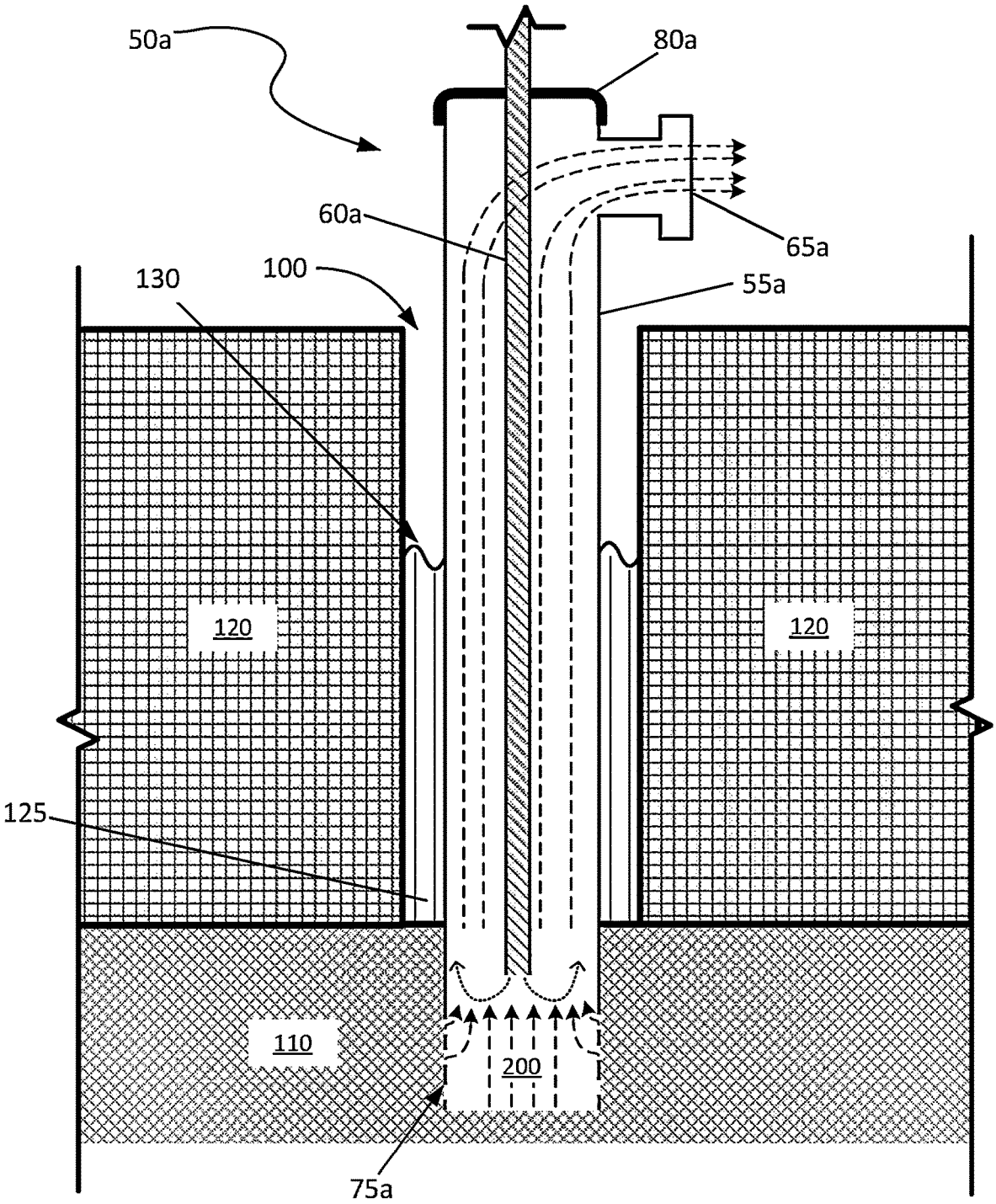
FIG. 5 is a diagram showing the apparatus of FIG. 4 in operation during an initial phase of removing sand from the underground sandstone formation in an underground water reservoir.

Referring to FIG. 5, the apparatus 50*a* is shown in use during the initial phase of extraction. In this example, the apparatus 50*a* is lowered into the sandstone formation 110. The perforated wall 75*a* is to be in the sandstone formation 110. As a gas is injected into to the conduit 55*a* near the lower end, the low pressure region 200 is formed to draw in additional sand slurry into the conduit 55*a* via the perforated wall 75*a*. As the sand slurry drawn from the sandstone formation 110 moves up the conduit 55*a* to the surface, the sand slurry may be collected or further processed after passing through the collection port 65*a*.

Figure 6:
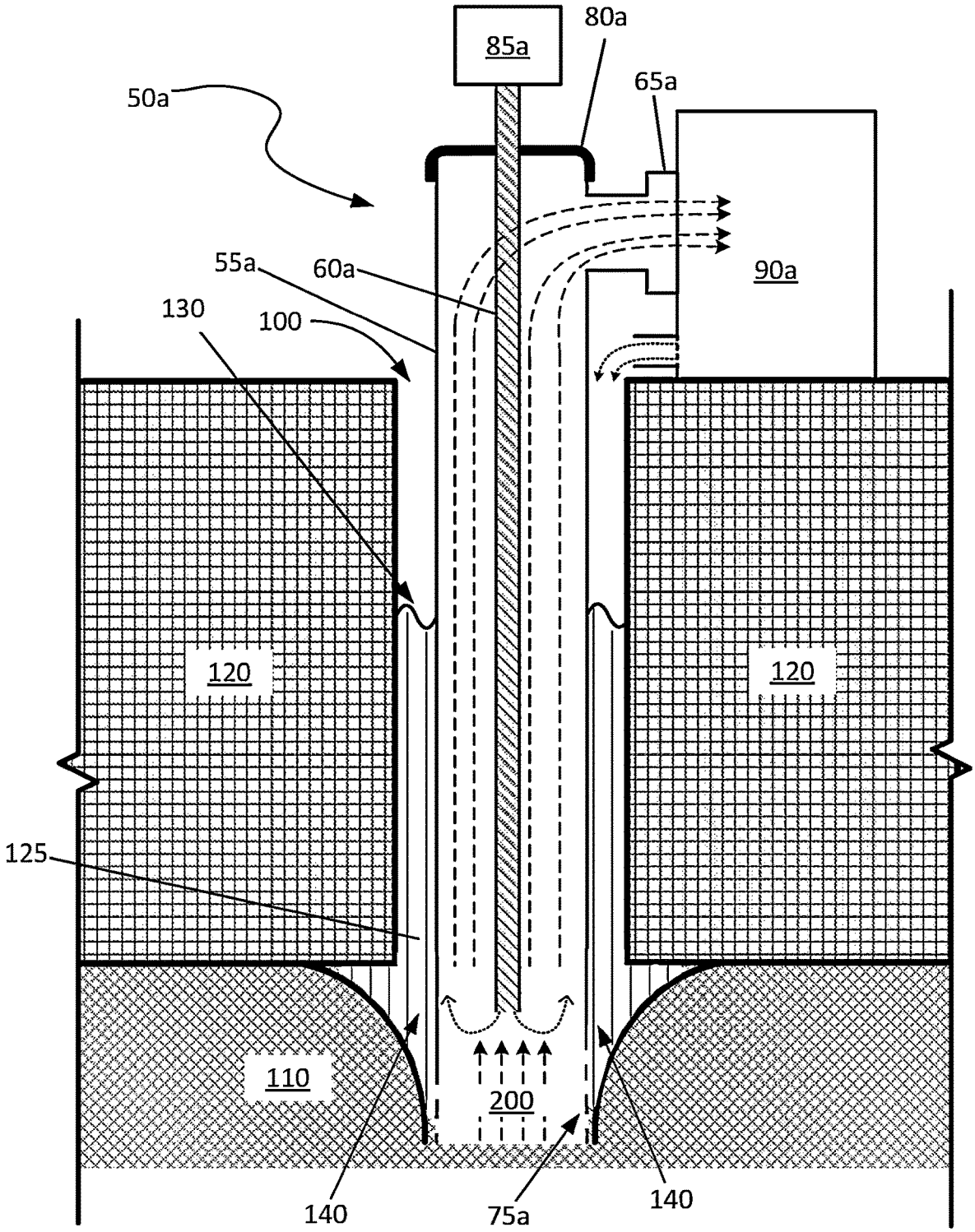
FIG. 6 is a diagram showing the apparatus of FIG. 4 in operation during the removal sand from the underground sandstone formation after the formation of a void.

Referring to FIG. 6, the apparatus 50*a* is shown in used and further along the process of removing material from the sandstone formation. In the present example, a void 140 is formed and filled with water. It is to be appreciated as the void forms and sand moves away from the perforated wall 75*a*, the advantages of the perforated wall 75*a* are negated since water may pass through the perforated wall. However, in some examples, the conduit 55*a* may be extended to maintain the perforated wall 75*a* below the sand to continue receiving the advantages of the perforated wall 75*a*. Alternatively, the gas injection line 60*a* may be used to generate a pressure vibration or pulse air to agitate the sand such that the void 140 is partially filled by settling of the sandstone formation 110 to cover the perforated wall 75*a*.

In the present example, a compressor 85*a* is shown connected to the gas injection line 60*a* to provide air pressure into the gas injection line 60*a*. The compressor 85*a* is not particularly limited and may provide a wide range of pressures as well as flow rates. In the present example, the pressure provided by the compressor 85*a* may be variable between about 30 psi and about 90 psi. Furthermore, the compressor 85*a* may provide a flow rate of about 300 cubic feet per minute to 600 cubic feet per minute.

A separator 90*a* may be connected to the collection port 65*a* to receive the sand slurry. The separator 90*a* is to separate the sand component from the water component as well as remove the air that is received from the collection port 65*a*. In the present example, the air is released into atmosphere. The water component and the sand component from the sand slurry may be separated by allowing the sand component to settle. In other examples, the separator 90*a* may use a filtration system.

Upon separating the water component from the sand component, the separator 90*a* may return the liquid component to the sandstone formation 110 by releasing the liquid component into the well 100 to maintain the static water level. In other examples, the sand component may be collected while the liquid component is discarded. For example, due to local regulations, it may not be possible to reintroduce the liquid component into the well 100 to reduce the possibility of contaminating the water in the aquifer.

Figure 7A:
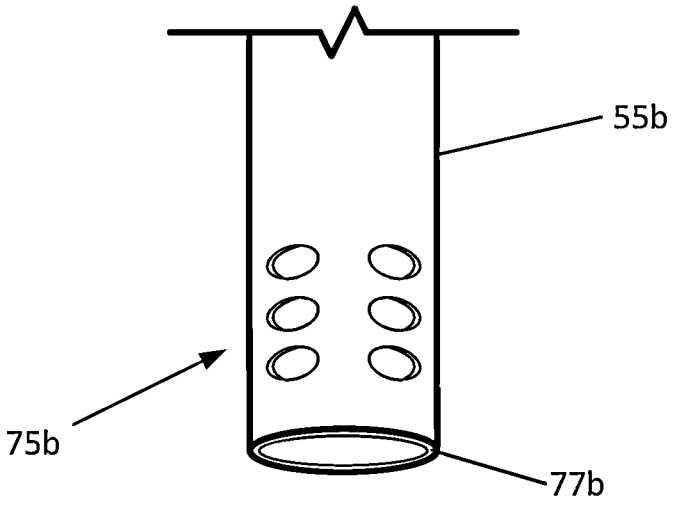
FIGS. 7A and 7B show another example of a lower end of a conduit used in an apparatus to extract sand from an underground sandstone formation.
Figure 7B:
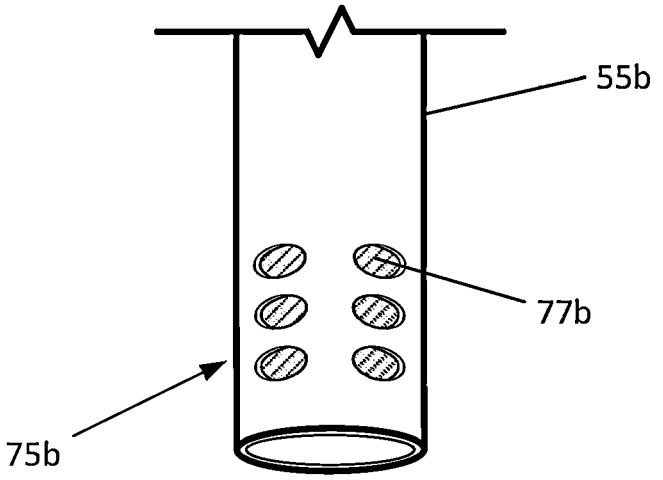

Referring to FIGS. 7A and 7B, a lower end of another example conduit 55*b* is illustrated. In the present example, the conduit 55*b* includes a perforated wall 75*b* configured to have two states. The first state shown in FIG. 7A is an open state where the perforated wall 75*b* includes opening from the inner portion of the conduit 55*b* to the outside sandstone formation. The second state shown in FIG. 7B is a closed state where the opens are closed effectively converting the perforated wall 75*b* into a solid wall. The manner by which the perforated wall 75*b* is converted from the open state to the closed state is not particularly limited. For example, the conduit 55*b* may include an inner wall 77*b* that fits within the inner diameter of the exterior wall of the conduit 55*b*. The inner wall 77*b* may include matching openings with exterior wall to provide the perforated wall 75*b* with openings between the interior of the conduit 55*b* and the exterior sandstone formation. To change the state of the perforated wall 75*b*, the inner wall 77*b* may be rotated so that the openings are no longer aligned as shown in FIG. 7B to close the openings. Similarly, the inner wall 77*b* may be rotated to open the perforations to return to the state shown in FIG. 7A. The inner wall 77*b* may be rotated automatically with controller and motor near the surface or manually rotated. In other examples, the openings of the perforated wall 75*b* may be manipulated via other mechanisms, such as longitudinally sliding inner wall 77*b*. In further examples, the inner wall 77*b* may be omitted and valves or other gate devices may be disposed on each opening of the perforated wall 75*b*.

It is to be appreciated by a person of skill with the benefit of this description that by increasing the surface area of a low pressure region to the sandstone formation at the lower end of the conduit, it is easier to draw in the sand slurry to start the extraction process during the initial phase. Accordingly, to initiate the extraction of sand from the sandstone formation, the perforated wall 75*b* may have the openings in the perforated wall 75*b* opened to be in the open state. Once a flow of sand slurry is established, the openings may no longer provide an advantage to toward maintaining the flow. This may be especially true when a void, such as the void 140 develops which causes any openings to draw water without sand. Accordingly, once the flow of sand slurry is established through the conduit 55*b*, the openings at the perforated wall 75*b* may be closed such that the suction of sand slurry from the main opening at the end of the conduit 55*b* where most of the sand is located will be increased.

Figure 8:
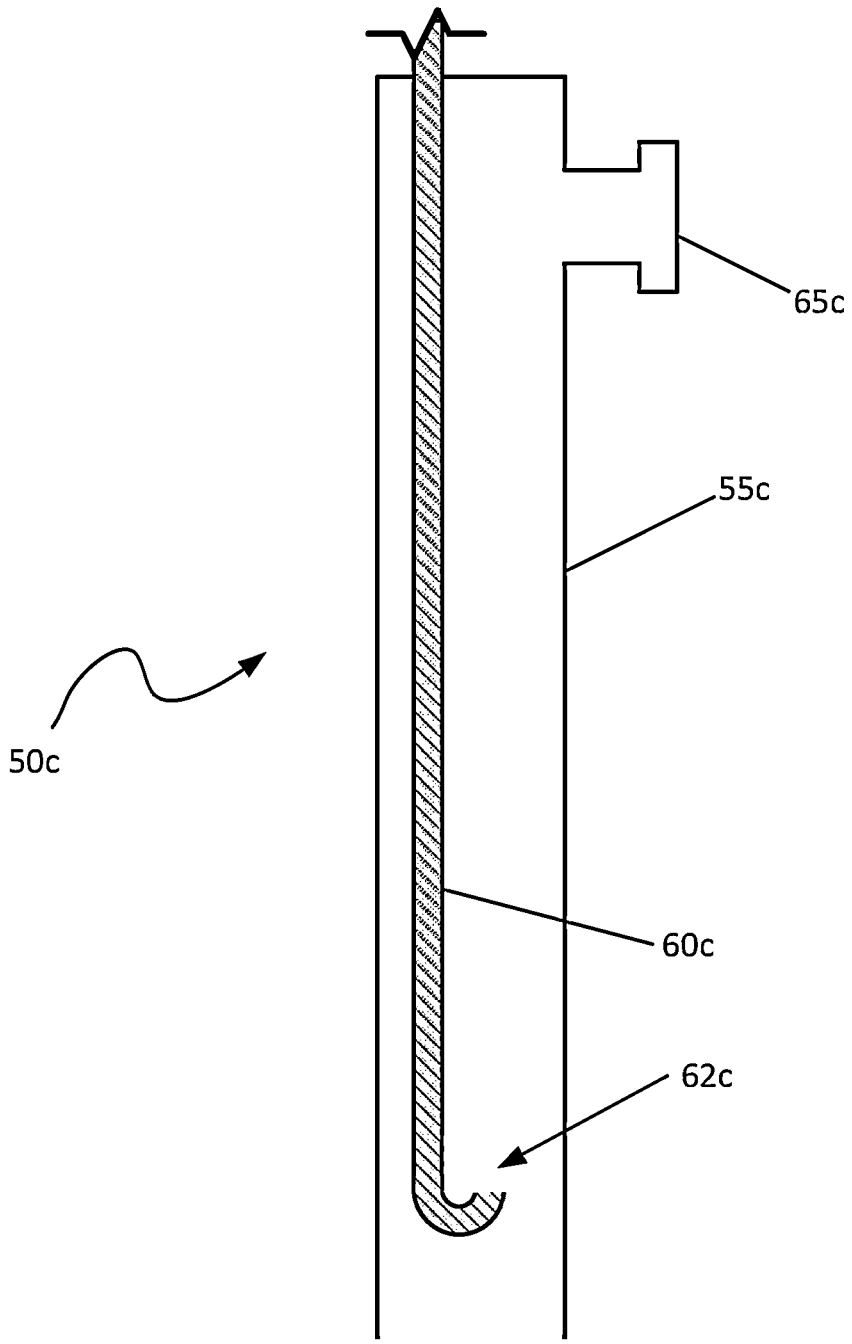
FIG. 8 is another example apparatus to extract sand from an underground sandstone formation in an underground water reservoir.

Referring to FIG. 8, another example of an apparatus 50*c* to extract sand from an underground sandstone formation in a water reservoir, such as an aquifer, is provided. Like components of the apparatus 50*c* bear like reference to their counterparts in the apparatus 50, except followed by the suffix "c". In the present example, the apparatus 50*c* may be is to be inserted into a well from the surface to the underground sandstone formation. The apparatus 50*c* includes a conduit 55*c*, a gas injection line 60*c*, and a collection port 65*c*.

In the present example, the conduit 55*c* and the collection port 65*c* are substantially similar to the conduit 55 and the collection port 65, respectively. In particular, the conduit 55*c* is to engage a sandstone formation near a lower end of the well. The collection port 65*c* is used to remove the sand slurry to be removed from the conduit 55*c*.

In the present example, the gas injection line 60*c* includes a directional injection point 62*c* at the lower end of the gas injection line 60*c*. It is to be appreciated that the directional injection point 62*c* is not particularly limited and may be to inject gas into the conduit 55*c* in any direction. In the present example, the gas injection line 60*c* includes an elbow to direct the gas or air in an upward direction and in the same direction as the flow of the sand slurry. In other examples, the directional injection point 62*c* may include directed the flow of gas at an angle. In further examples, the gas injection line 60*c* may include a mechanism where the directional injection point 62*c* may direct the flow of gas and have the capability of changing directions during operation. In such an example, the direction of the injected gas may be another variable that can be adjusted to increase the flow of the sand slurry.

It should be recognized that features and aspects of the various examples provided above may be combined into further examples that also fall within the scope of the present disclosure.

What is claimed is:

1. A method comprising:

lowering a lower end of a pipe into a sandstone formation;

injecting air into the pipe proximate to the lower end to generate a low pressure region at the lower end to draw a sand slurry from the sandstone formation; and collecting the sand slurry at a collection port proximate to an upper end of the pipe.

2. The method of claim 1, further comprising opening perforations on a wall of the pipe to increase surface area between the low pressure region and the sandstone formation.

3. The method of claim 1, further comprising injecting a pulse of air to agitate the sandstone formation.

4. The method of claim 1, further comprising extending the pipe to lower the lower end further into the sandstone formation as a void forms.

5. The method of claim 1, further comprising moving a gas injection line within the pipe to adjust an injection point, wherein adjusting the injection point is to vary the low pressure region.

6. The method of claim 1, further comprising adding water to a well to establish a static water level at a predetermined height above the sandstone formation.

7. The method of claim 6, further comprising separating a sand component from a water component in the sand slurry.

8. The method of claim 7, further comprising returning the water component to the well to maintain the static water level.

9. An apparatus comprising:

a conduit having a lower end and an upper end, wherein the lower end is to engage a sandstone formation, and wherein the lower end is opposite the upper end;

a gas injection line to inject gas at an injection point proximate to the lower end, wherein the gas injected at the injection point generates a low pressure region at the lower end to draw a sand slurry from the sandstone formation; and a collection port proximate to the upper end of the conduit, wherein the sand slurry in the conduit is to be removed from the conduit via the collection port.

10. The apparatus of claim 9, wherein the lower end of the conduit includes a perforated wall to increase surface area at the sandstone formation.

11. The apparatus of claim 10, wherein the perforated wall is to be in one of a closed state or an open state.

12. The apparatus of claim 9, wherein the injection point is adjustable relative to the lower end of the conduit to maintain a flow of the sand slurry.

13. The apparatus of claim 9, wherein the gas injection line is to inject a pulse of gas to agitate the sandstone formation.

14. The apparatus of claim 9, wherein the conduit is extendible to be lowered further into the sandstone formation as the sand slurry is removed.

15. The apparatus of claim 9, further comprising a cover at the upper end of the conduit.

16. The apparatus of claim 15, wherein the cover is made of steel with a flexible membrane seal.

17. The apparatus of claim 16, wherein the cover includes an opening for the gas injection line to pass therethrough, the cover forming an airtight seal at the upper end of the conduit.

18. The apparatus of claim 17, wherein the cover is to slidably engage the gas injection line, and wherein the gas injection line is slidably moveable within the conduit to control the injection point.

19. The apparatus of claim 9, further comprising a separator connected to the collection port to receive the sand slurry, wherein the separator is to separate a sand component from a liquid component.

20. The apparatus of claim 19, wherein the separator is to return the liquid component to the sandstone formation to maintain a static water level.

* * * * *